United States Patent [19]

Zingler

[11] Patent Number: 4,601,326

[45] **Date of Patent: * Jul. 22, 1986**

[54] RIBBON CASTING APPARATUS WITH MAGNETIC RETAINER AND RESILIENT SPACER

[75] Inventor: Christian J. Zingler, Succasunna, N.J.

[73] Assignee: Electric Power Research Institute, Inc., Palo Alto, Calif.

[ * ] Notice: The portion of the term of this patent subsequent to Mar. 26, 2002 has been disclaimed.

[21] Appl. No.: 736,285

[22] Filed: May 20, 1985

Related U.S. Application Data

[63] Continuation of Ser. No. 471,996, Mar. 4, 1983, abandoned.

[51] Int. Cl.[4] ..... B22D 27/02; B22D 11/06

[52] U.S. Cl. ..... 164/502; 164/423; 164/463; 164/429

[58] Field of Search ..... 164/423, 463, 502, 429

[56] References Cited

U.S. PATENT DOCUMENTS 3,315,958 4/1967 Geeson ..... 271/193

4,506,725 3/1985 Bedell ..... 164/463

*Primary Examiner*—Kuang Y. Lin

*Attorney, Agent, or Firm*—King and Schickli

[57] ABSTRACT

A casting assembly for controllably depositing an elongated, thin cast ribbon on a substrate includes a means for magnetically retaining the ribbon on the substrate. A relatively thin spacer leaf is secured in contacting relationship with the substrate to separate the substrate and the magnets. The spacer is flexible and resilient both in the direction of substrate movement and across the width of the substrate to accommodate irregularities in the surface and movement of the substrate, reducing belt wear and power requirements and improving smoothness of substrate movement.

14 Claims, 3 Drawing Figures

10
15
25
18
20
24
22
12
40
32
30
11
19
16
38
36
34
3

RIBBON CASTING APPARATUS WITH MAGNETIC RETAINER AND RESILIENT SPACER

This is a continuation of application Ser. No. 471,996, filed Mar. 4, 1983, now abandoned.

TECHNICAL FIELD

The invention relates to metal casting of continuous metal strips by controllably depositing molten metal through an elongated dispensing slot onto a moving chilled substrate adjacent the dispensing slot. In particular, the invention is directed to a casting apparatus including a flexible and resilient spacer leaf for separating and biasing the substrate from a magnet used to retain the cast ribbon against the substrate.

BACKGROUND OF THE INVENTION

In a process of continuously casting metal strips, such as ribbons, it is common practice to dispense the molten metal through a nozzle onto a moving chilled substrate. The molten metal solidifies soon after contact with the chilled substrate. A cast product having an amorphous molecular structure, in the form of a relatively thin elongated strip or ribbon, has proven to be effective for winding into highly efficient cores of electrical transformers, and other uses. Recent developments in the casting of amorphous metal strips are reviewed in U.S. Pat. No. 4,332,848.

The ribbon may be transported a substantial distance during the quenching process before it is delivered to other processing equipment, such as measuring or winding equipment. In one arrangement, the ribbon is transported on top of a moving belt substrate. In such circumstances, the ribbon exhibits a tendency to shift on the rapidly moving belt during transport.

In one advantageous casting technique, the cast ribbon is deposited onto the upper run of an endless belt adjacent or directly above an end roller. The belt quickly travels about the end roller to position the cast ribbon upside down on the lower run of the belt. Since the ribbon then clings to the belt against gravity bias, there is an even greater tendency for the ribbon to shift or even fall off the belt. Regardless as to whether the ribbon is transported on top of the belt or on the lower run of the belt, the premature departure of the ribbon from its preferred position on the belt has deleterious consequences.

It has been proposed that ribbons cast of ferromagnetic material may be retained on a casting belt by magnetic attraction. A line of magnets is positioned proximal to an inner face of the belt (opposite the casting surface). The casting belt may be formed of ferromagnetic, paramagnetic or non-magnetic material. If the belt is formed of paramagnetic or non-magnetic material, the magnetic attraction force is then applied through the casting belt to retain the ribbon against the belt. If, however, the belt is formed of ferromagnetic material, both the belt and the ribbon are attracted toward the magnets. In either case, the ribbon is prevented from prematurely departing from the belt. The strength of the magnetic field is designed to exceed the inertial and gravitational forces urging the ribbon off the belt.

The use of magnets cooperating with delivery belts to cause ferrous metal sheet material to adhere to a belt for transport is disclosed in U.S. Pat. No. 3,315,958. In this patent, elongated stationary skids of non-magnetic material are interposed between the belts and the magnets. These stationary skids extend along the entire belt/magnet interface, separating the belts from the magnets and serving as a rigid bearing surface for facilitating belt movement of the belts.

The use of skids along the entire belt/magnet interface results in excessive frictional forces. The frictional forces becoming particularly pronounced as the retention length of the belt increases. As a result, substantial power is required for moving the belt. Furthermore, the excessive frictional forces generated by the belt movement adversely affects the smoothness of belt movement and causes premature belt wear.

SUMMARY OF THE INVENTION

Accordingly, it is a primary object of the invention to provide a casting apparatus including a spacer for efficiently separating a mcving casting substrate from a retention means.

It is a further object of the invention to provide a casting apparatus having a moving casting belt with means spaced from the belt to efficiently retain a cast product.

It is another object of the invention similar to the above objects to provide an apparatus of the type described avoiding excessive frictional forces between a casting belt and a spacer interposed between the belt and a magnet.

Another object of the invention is to improve precision control of a casting belt and a cast ribbon thereon moving along a linear magnetic field.

Yet another object of the invention is to minimize the contacting area between a casting belt and a spacer separating the belt from a magnet generating a magnetic field to provide retention of the cast product.

Still another object of the invention is to maximize the heat transfer in a casting system through use of a casting substrate with adjacent magnetic retention means and a cooling assembly for cooling the substrate to facilitate metal solidification.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved apparatus is provided for casting a continuous ferromagnetic ribbon. The apparatus includes a reservoir for molten metal and a means for dispensing a relatively thin, elongated ribbon from molten metal in the reservoir. A continuously moving substrate is provided with a casting surface (outer face) for receiving and quenching the dispensed ferromagnetic ribbon. A plurality of magnets are disposed proximal to the substrate opposite the casting surface for applying an attractive (magnetic) force to retain the cast ribbon on the substrate.

In accordance with the broad aspects of the invention, a spacer is secured in contacting relationship with the substrate. The spacer is relatively thin in the direction of substrate movement so as to form a flexed, spring-biased leaf to resiliently hold the substrate away from the magnets.

The spacer leaf extends to the substrate in a direction substantially perpendicular to the casting surface. The spacer leaf preferably flexes in the direction of belt movement.

In one preferred form of the invention, the magnetic means includes a plurality of magnets with the spacer leaf extending to engage the substrate between a pair of the magnets.

In one aspect of the invention, the substrate is formed of ferromagnetic material and attracted to the magnets with the ferromagnetic ribbon.

In yet another aspect of the invention, the substrate is formed of paramagnetic or non-magnetic material and the ribbon is attracted to the magnets through the substrate.

According to a more specific aspect of the invention, the spacer leaf is formed of a non-magnetic metal material exhibiting qualities of a leaf spring so as to resiliently bias the substrate away from the magnets. The leaves thus can resiliently flex and help to absorb dynamic shock in the belt during operation. In a preferred form of the invention, the spacer is formed of stainless steel shim stock having a thickness (in second direction of belt movement) on the order of only 0.007 inch. With the spacer flexed as indicated, each leaf engages the substrate along substantially line contact with minimized friction and drag on the belt, and under efficient dissipation of frictional heat.

According to a further aspect of the invention, the substrate is an endless belt having a cooling box for cooling the belt to facilitate solidification of the cast product. The spacer is operative to serve as a scraper to remove foreign particles and film from the substrate, and thus to improve heat transfer from the belt in the cooling box.

Still other objects of the present invention will become readily apparent to those skilled in this art from the foregoing description wherein there is shown and described a preferred embodiment of this invention, simply by way of illustration, of one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the invention, and together with the description serve to explain the principles of the invention. In the drawings.

Figures 1, 2, 3:
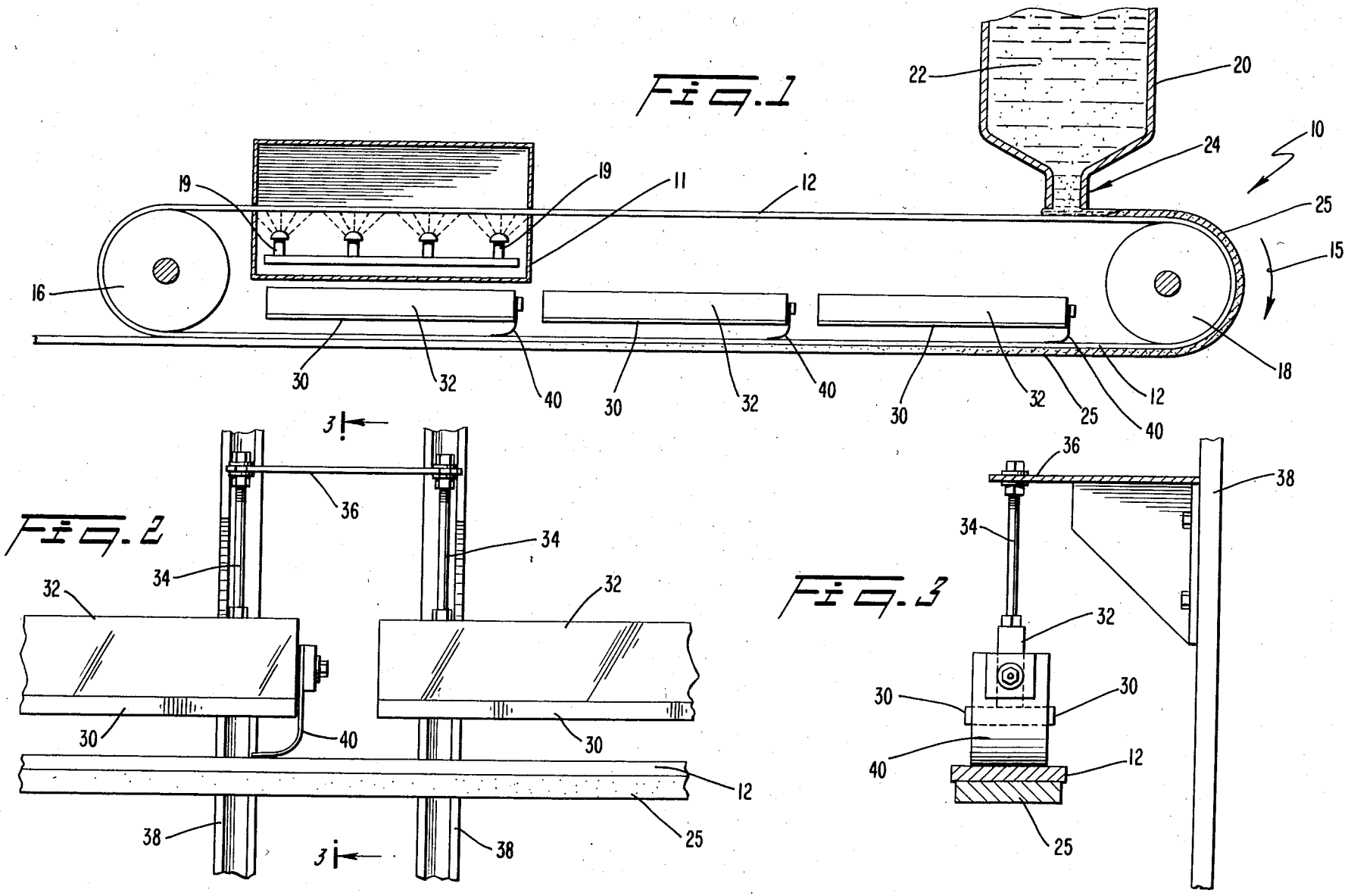
FIG. 1 is a side elevational view, but partially in cross-section, of a casting assembly according to the present invention.
FIG. 2 is an enlarged side elevational view of the lower portion of the casting assembly shown in FIG. 1 depicting a spacer leaf disposed between a pair of aligned magnets proximal to the lower run of the casting belt.
FIG. 3 is a sectional view taken along line 3—3 in FIG. 2 showing the spacer and its relationship to the casting belt along the width of the belt.

Reference will now be made in detail to the present preferred embodiment of the invention, an example of which is illustrated in the accompanying drawings.

BEST MODE OF CARRYING OUT THE INVENTION

Reference is first made to FIG. 1 schematically depicting a casting assembly 10 for casting a relatively thin, elongated strip or ribbon of amorphous metal. The casting assembly 10 includes a continuously moving substrate in the form of an endless belt 12. The endless belt 12 provides a casting surface for receiving and quenching the cast metal ribbon. The endless belt 12 extends between a pair of end rollers 16 and 18 and is continuously moved in a clockwise direction in FIG. 1 as indicated by arrow 15.

A crucible 20 is disposed above the belt 12 near the end roller 18. The crucible 20 provides a reservoir of amorphous metal material 22 for supplying a casting nozzle 24. The nozzle 24 is positioned immediately above the casting surface of the belt 12, either adjacent or directly over the end roller 18. Molten metal 22 supplied to the nozzle 24 is discharged on the casting surface of the belt 12 in the form of a continuous, thin, elongated ribbon 25. The ribbon 25 clings to the belt 12 about the end roller 18 and is transported to the lower run of the belt 12 along a retention area between the end rollers 16,18. In the depiction of FIG. 1, the thickness of the ribbon 25 has been exaggerated for clarity of illustration. In actuality, the ribbon 25 is substantially thinner than the belt 12.

The belt 12 discharges the ribbon 25 adjacent to the end roller 16 for delivery to other processing equipment, such as measuring or winding equipment. After discharging the ribbon 25, the belt 12 is moved about end roller 16 for travel along a return path to the dispensing nozzle 24. A cooling box 11 is disposed about the belt 12 along the return path for cooling the belt 12 to expedite solidication of the molten metal deposited thereon. The illustrated cooling box 11 includes a plurality of water jets 19 for directing chilled water onto the inner surface of the belt 12.

Transporting the cast ribbon 25 on the underside of belt 12 subjects the ribbon 25 to gravitational forces tending to separate the ribbon 25 from the casting surface. In order to overcome this tendency, a plurality of magnets 30 are disposed proximal to the interior surface of the belt 12 in the retention area between end rollers 16 and 18. Since the ribbon 25 is ferromagnetic, it is retained against the belt 12 by the magnets 30 in the retention area against both gravitational and inertial forces.

Retention of the ribbon 25 to the belt 12 is possible irrespective of the magnetic properties of the belt 12. If the belt 12 is formed of either non-magnetic or paramagnetic material, the attractive force between the magnets 30 and the ribbon 25 will be applied through the belt. If, on the other hand, the belt 12 is formed of ferromagnetic material, both the ribbon 25 and the belt 12 are attracted toward the magnets 30. In either case, the ribbon 25 is retained against the belt 12.

Referring now to FIG. 2, the magnets 30 are illustrated in the retention area between end rollers 16 and 18 in spaced relationship to the inner surface of belt 12. Each of the magnets 30 is preferably a permanent bar magnet and has an elongated plate configuration. Each magnet is rigidly secured to perpendicularly disposed support structure 32 by appropriate fastening means. The magnets 30 and the support structures 32 are aligned in end to end relationship. In the illustrated form, the magnets 30 and support structures 32 have an inverted "T" cross-sectional configuration, as seen in FIG. 3. Each longitudinal end of the support structure 32 is supported by a threaded rod 34 downwardly depending from a horizontal support plate 36. The horizontal support plate 36 is, in turn, upheld by a plurality of columnar support members 38.

In the absence of some provision for separating the belt 12 from the magnets 30, the inner surface of the belt 12 would be magnetically forced against the magnets 30. The magnets 30 of the preferred embodiment extend along substantially the entire retention zone between the end rollers 16 and 18. Thus, direct interfacing between the belt 12 and the magnets 30 leads to highly undesirable results. The friction resulting from direct magnetic interfacing would substantially increase the power requirements for moving the belt 12. The resulting friction would also cause substantial belt wear and adversely affect smooth belt movement. Furthermore, interfacing the belt 12 with the magnets 30 along an extended distance would increase the possibility of depositing foreign material on the inner surface of the belt 12. Foreign material on the inner belt surface hinders heat transfer in the cooling box 11, substantially reducing the operational efficiency of the casting assembly 10.

In order to overcome these disadvantages, a plurality of spacer leaves 40 are provided for maintaining a space between the magnets 30 and the belt 12. As shown in FIGS. 2 and 3, each illustrated spacer leaf 40 is a relatively thin, resilient stainless steel shim stock material. In the preferred embodiment, the spacer has a thickness in the order of 0.007 inch in the direction of belt movement.

The spacer leaf 40 is secured to a longitudinal end of one of the support structures 32, such as by a bolt and washer combination as shown in FIG. 2. The leaf 40 extends downwardly between the magnets 30 in a first direction substantially perpendicular to the casting surface and is fixed in position so as to be flexed like a spring thereby biasing the belt 40 away from the corresponding magnet 30. The relative thinness of the spacer 40 in the direction corresponding to the direction of belt movement permits the spacer to flex in this manner.

As seen in FIG. 3, the spacer 40 has a substantially larger dimension in the direction across the width of belt 12 than in the direction of belt movement. The width should be about $\frac{2}{3}$ of the width of the belt in order to provide the proper spring biasing action and the desired scraping action.

The use of the illustrated spacer leaf 40 is highly advantageous. It effectively separates the belt 12 from the magnets 30 with a minimum of contact area. The resulting friction is thus minimized, lessening the tendency for the belt to jerk due to the cyclic buildup and release of frictional forces. Also, the belt wear and power requirements for moving the belt 12 are greatly reduced. Smoothness of belt operation is also improved due to the shock absorbing nature of the resilient spacer leaves 40.

The spacer leaf 40 is preferably formed of a non-magnetic metal to avoid interfering with the magnetic circuit formed by the magnets 30. It has been found that a non-coated metal, such as stainless steel, provides a sufficiently low frictional interface surface. The stainless steel also exhibits excellent elastic memory and wear properties to reduce the frequency of replacing the spacer leaf 40. Many other materials and coatings offer even lower friction. However, many of these materials and coatings, such as polytetrachlorethylehe, for example, tend to wear onto the inner surface of the belt 12. As noted above, any foreign matter, such as a plastic film, on the interior surface of the belt 12 tends to hinder heat transfer in the cooling box 11, seriously reducing the quenching capability of the casting assembly 10. Not only does the design of spacer leaf 40 minimize the possibility of depositing foreign material on the inner belt surface, it actually functions as a scraper to remove any foreign materials, which could cause belt damage if carried between the belt 12 and pulley 16.

The spacer 40 is flexible and resilient, not only in the direction corresponding to belt movement, but also in the direction across the belt width. Thus, the spacer 40 readily accommodates and absorbs lateral shocks occurring in the belt during movement.

In summary, numerous benefits have been described which result from employing the concepts of the invention. The casting assembly 10 of the invention uses retainer magnet 30 for a product cast on a substrate 12. The substrate is separated from the retainer magnet by a flexible spacer leaf 40 minimizing surface contact with the substrate. Wear of the substrate 12 is thus reduced. The power requirements for moving the casting belt are also reduced, and smoothness of belt movement is improved. Furthermore, the spacer leaf 40 minimizes thermal interference between the substrate and a cooling box, not only by reducing the possibility of despositing foreign particles, but also by removing any particles which may be on the substrate. The spacer is flexible and resilient in the direction of substrate movement and preferably across the substrate width to accommodate irregularities in substrate movement and surface irregularities.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in the various embodiments and with various modifications as are suited to the particular use contemplated. It is intended that the scope of the invention be defined by the claims appended hereto.

I claim:

1. An apparatus for casting a continuous ferromagnetic ribbon, comprising:

(a) a reservoir for molten metal;

(b) means for dispensing a relatively thin, elongated ribbon from molten metal in the reservoir;

(c) a continuously moving substrate, said substrate including a casting surface for receiving and quenching the dispensed ferromagnetic metal ribbon;

(d) attracting means disposed proximal to said substrate for applying an attractive force to retain the cast ribbon against the substrate; and (e) spacer means secured in contacting relationship with said substrate for separating the substrate from the attracting means, said spacer means being flexible and resilient in the direction of substrate movement so as to flex under the interaction force with the substrate and bias the substrate away from said attracting means.

2. An apparatus as recited in claim 1 wherein the spacer means extends to the moving substrate in a direction substantially perpendicular to the casting surface for separating the substrate from the attracting means, said spacer means including a relatively thin leaf to engage and bias the substrate away from the attracting means.

3. An apparatus as recited in claim 1 wherein the attracting means includes a plurality of magnets.

4. An apparatus as recited in claim 3 wherein the spacer means extends to the substrate between a pair of the magnets.

5. An apparatus as recited in claim 3 wherein said substrate is formed of ferromagnetic material and is attracted to the magnets with the ribbon.

6. An apparatus as recited in claim 3 wherein said substrate is formed of paramagnetic or non-magnetic material and the ribbon is attracted to the magnets through the substrate.

7. An apparatus as recited in claim 1 wherein the spacer means is also flexible in the lateral direction across the substrate.

8. An apparatus as recited in claim 2 wherein the spacer leaf is formed of non-magnetic material.

9. An apparatus as recited in claim 8 wherein the spacer leaf is formed of metal.

10. An apparatus as recited in claim 9 wherein the metal spacer leaf is formed of stainless steel.

11. An apparatus as recited in claim 10 wherein the spacer leaf is formed of stainless steel shim stock.

12. An apparatus as recited in claim 11 wherein the thickness of the spacer leaf is in the order of 0.007 inch.

13. An apparatus as recited in claim 2 further including a cooling box for cooling the substrate, the spacer leaf being operative to scrape and remove foreign particles from the substrate to improve heat transfer from the substrate in the cooling box.

14. An apparatus as recited in claim 2 wherein said spacer leaf engages said substrate along substantially line contact.

* * * * *